US005388347A

United States Patent [19]

Kerttula et al.

[11] Patent Number: 5,388,347

[45] Date of Patent: Feb. 14, 1995

[54] DRYER SECTION IN A PAPER MACHINE

[75] Inventors: Reima Kerttula; Jouko Yli-Kauppila, both of Muurame, Finland

[73] Assignee: Valmet Paper Machinery, Inc., Helsinki, Finland

[21] Appl. No.: 174,710

[22] Filed: Dec. 29, 1993

[30] Foreign Application Priority Data

Dec. 30, 1992 [FI] Finland ..... 925941

[51] Int. Cl.[6] ..... F26B 3/00

[52] U.S. Cl. ..... 34/457; 34/117; 34/120; 34/452; 162/193

[58] Field of Search ..... 34/443, 444, 454–458, 34/453, 114–123; 162/206, 207, 193

[56] References Cited

U.S. PATENT DOCUMENTS

| | | | |
|---|---|---|---|
| 4,202,113 | 5/1980 | Kankaanpaa | 34/23 |
| 4,967,489 | 11/1990 | Autio | 34/116 |
| 4,972,608 | 11/1990 | Ivespää | 34/116 |
| 5,063,689 | 11/1991 | Sollinger | 34/115 |
| 5,205,025 | 4/1993 | Kielwein et al. | 29/436 |
| 5,232,554 | 8/1993 | Kotitschke | 162/193 |
| 5,248,390 | 9/1993 | Fissmann et al. | 34/117 |

FOREIGN PATENT DOCUMENTS

| | | |
|---|---|---|
| 0426607 | 5/1991 | European Pat. Off. . |
| 915564 | 5/1992 | Finland . |
| 4024955 | 2/1992 | Germany . |
| 4201107 | 8/1992 | Germany . |
| 8806204 | 8/1988 | WIPO . |
| 8806205 | 8/1988 | WIPO . |
| 9208004 | 5/1992 | WIPO . |

*Primary Examiner*—Denise L. Gromada
*Attorney, Agent, or Firm*—Steinberg, Raskin & Davidson

[57] ABSTRACT

A dryer section in a paper machine for drying a paper web, having normal dryer groups with a single-wire draw in which drying cylinders are arranged in an upper row and reversing cylinders in a lower row. The dryer section has at least one inverted dryer groups in which drying cylinders are arranged in a lower row and reversing cylinders are arranged in an upper row. In view of making the dryer section more compact, intensifying the evaporation, reducing the transverse shrinkage of the web, and/or improving the runnability of the web, the drying cylinder and/or the reversing cylinder or roll placed in connection with the transfer over the gap between the groups is/are placed so that its/their height position is displaced as compared with the other cylinders in the same group. In an inverted group, an upper reversing cylinder is arranged in connection with blower devices for drying air for the web. The blowings directed from the blower devices increase the evaporation from the web and/or control the transverse moisture profile in the web.

29 Claims, 8 Drawing Sheets

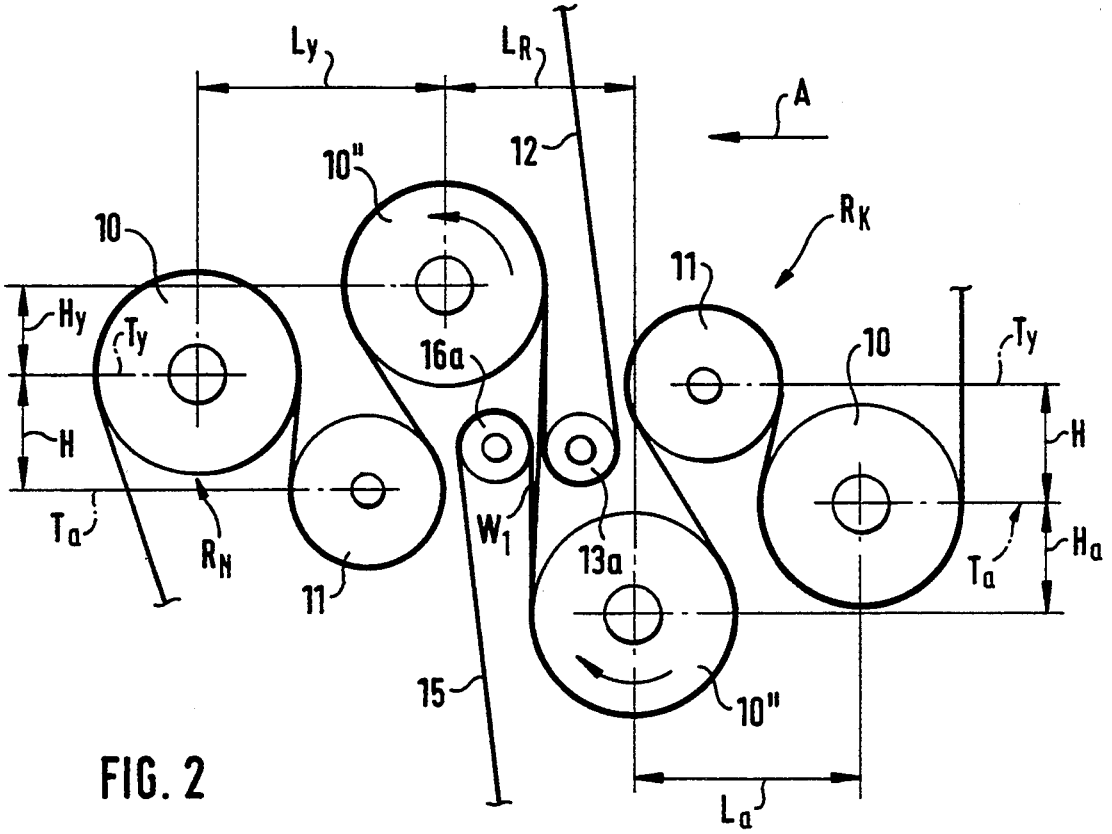
FIG. 2
FIG. 4
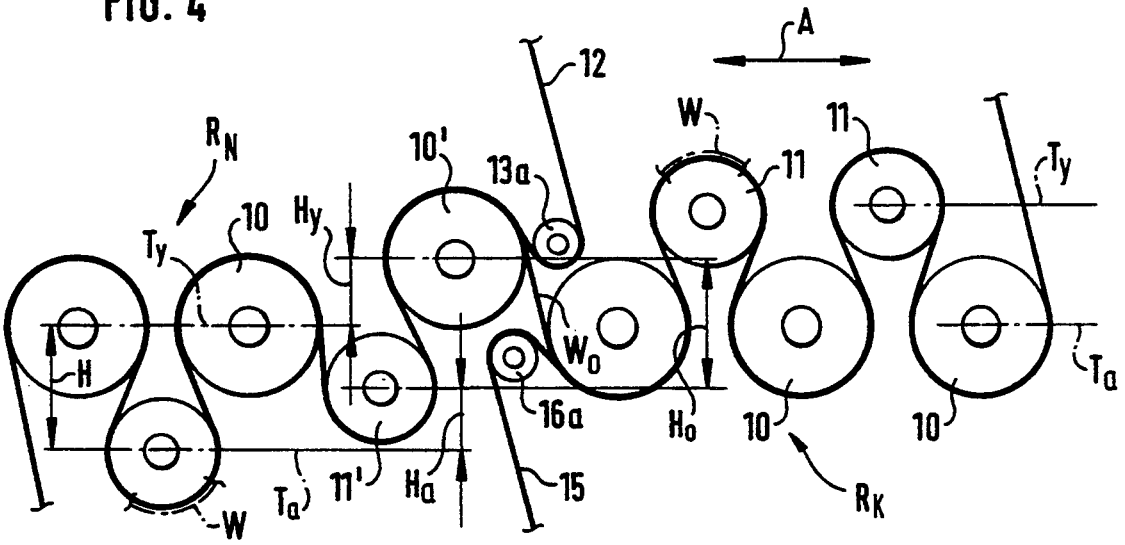

DRYER SECTION IN A PAPER MACHINE

BACKGROUND OF THE INVENTION

The present invention relates to a dryer section in a paper machine, comprising so-called normal dryer groups provided with a single-wire draw and in which drying cylinders are arranged in an upper row and reversing cylinders or rolls are arranged in a lower row. The dryer section has at least one so-called inverted group, in which the drying cylinders and the reversing cylinders or rolls are arranged in rows in an inverted order with respect to the order of arrangement in the normal dryer groups. The present invention also relates to a method for improving the drying characteristics of a paper web in the dryer section.

In the prior art, in multi-cylinder dryers in paper machines, twin-wire draw and/or single-wire draw is/are employed. In a twin-wire draw, the groups of drying cylinders include two wires which press the web against heated cylinder faces, one wire from above and the other one from below. Between the rows of cylinders, which are usually horizontal rows, the web has free and unsupported draws which are susceptible of fluttering, possibly causing web breaks. For this reason, in recent years, increasing use has been made of the single-wire draw, in which there is just one drying wire in each group of drying cylinders. The web runs on support of the drying wire through the whole group so that, on the drying cylinders, the drying wire presses the web against the heated cylinder faces, and on the reversing cylinders arranged between the drying cylinders, the web remains at the side of the outside curve. Thus, in a single-wire draw, the drying cylinders are arranged outside the wire loop, and the reversing cylinders are arranged inside the loop of the drying wire.

In prior art normal dryer groups with a single-wire draw, the heated drying cylinders are placed in the upper row, and the reversing cylinders are placed in the lower row. The upper and lower rows are usually horizontal and parallel to one another. In the assignee's Finnish Patent No. 54,627 (corresponding to U.S. Pat. No. 4,202,113, the specification of which is hereby incorporated by reference herein), an arrangement is described in which normal single-wire groups, such as those described above, and so-called inverted single-wire groups are arranged one after the other. In the inverted groups, the heated drying cylinders are placed in the lower row and the reversing suction cylinders or rolls in the upper row. As a result of this arrangement, the web is dried substantially symmetrically from both of its sides.

In the prior art, reference is also made to International Patent Applications WO 88/06204 and WO 88/06205 of Messrs. Beloit Corp. which describe a dryer section consisting of normal and inverted cylinder groups.

In the following description, the terms "normal (dryer) group" and "inverted (dryer) group" are used and generally connote the cylinder groups with a single-wire draw similar to those described above.

In the group gap draws between inverted and normal drying groups, various problems have occurred, for which the present invention offers novel efficient solutions. These problems include the large length of the dryer section, which increases the cost of the dryer section and of the machine hall. Problems have also occurred in the runnability of the dryer section and in the web transfer, problems arising from differences in speed between different wires, problems in the removal of broke, and problems related to transverse shrinkage of the web. Generally, these problems tend to become worse with increasing running speeds of the paper machines.

OBJECTS AND SUMMARY OF THE INVENTION

Accordingly, it is an object of the present invention to provide novel solutions for the problems discussed above, as well as further development of dryer sections that comprise normal and inverted single-wire groups.

It is another object of the present invention to make a dryer section for a paper machine more compact, intensify the evaporation of water from the web, reduce the transverse shrinkage of the web, and improve the runnability of the web.

It is yet another object of the present invention to provide a new and improved dryer section in which the evaporating capacity of an inverted drying group is increased and the transverse moisture profile of the web is controlled more efficiently than in prior art dryer sections.

It is still another object of the present invention to provide a new and improved method for intensifying evaporation of water from a web, reducing transverse shrinkage of the web and improving runnability of the web in a dryer section of a paper machine.

In view of achieving the objects stated above and others, in a first embodiment of the invention, for which various exemplifying embodiments are shown in the accompanying FIGS. 1 to 6 and 9, the dryer section comprises a transfer arrangement to transfer the web over the gap between a normal group and an inverted group. In this connection, in view of making the dryer section more compact, intensifying the evaporation, reducing the transverse shrinkage of the web, and/or in view of improving the runnability, a drying cylinder and/or a reversing cylinder or roll placed in connection with the transfer of the web over the gap between the groups, is/are placed so that its/their height position is displaced substantially as compared with the other cylinders in the same group.

In a second embodiment of the present invention, the dryer section comprises a transfer arrangement to transfer the web over the gap between a normal group and an inverted group. In order to make the dryer section more compact, intensify the evaporation, reduce the transverse shrinkage of the web, and/or improve the runnability, the drying cylinder and/or the reversing cylinder or roll, placed in connection with the transfer over the gap between the groups, has a diameter which is substantially larger than the diameter of the wire-leading rolls. Further, the drying cylinder and/or reversing cylinder or roll have a height position which is displaced substantially as compared with the other cylinders in the same group.

In the first embodiment of the present invention, in connection with the group gap transfer, the normal geometries and the normal relative positions of the different parts are abandoned, and novel efficient solutions are provided for the problems discussed above, in a manner that will be described in more detail later.

In the second embodiment of the invention, which has two alternative exemplifying embodiments as shown in FIGS. 7 and 8, which will be explained later, the evaporating capacity of the inverted group or groups can be increased, and/or the transverse moisture profile of the web can be controlled better and more efficiently than in prior art dryer sections.

A third embodiment of the present invention is particularly favorable in which the first and the second embodiments are used together in combination with each other. In this case, several advantages of different natures are carried into effect synergically at the same time.

In the method in accordance with the invention, the evaporation of water from a web is intensified, transverse shrinkage of the web is reduced and runnability of the web is improved in a dryer section of a paper machine. A normal dryer group is provided having a single-wire draw, drying cylinders in an upper row at a first height level and reversing cylinders in a lower row. An inverted dryer group is situated adjacent the normal dryer group and has drying cylinders in a lower row at a second height level and reversing cylinders in an upper row. The web is transferred over a gap between one of the drying cylinders in the normal group and one of the drying cylinders in the inverted group arranged in connection with the transfer of the web over the gap. The first cylinder and/or the second cylinder is displaced in a vertical direction from the first height level and the second height level, respectively, e.g., to lengthen the distance of the free gap by displacing the first cylinder upward in relation to the first height level and displacing the second cylinder downward in relation to the second height level.

In a preferred embodiment of the invention, the first cylinder and second cylinder can be displaced from their normal position in a machine direction, e.g., such that the distance between the first cylinder and second cylinder is reduced. One of the reversing cylinders situated adjacent the first cylinder and/or a second one of the reversing cylinders situated adjacent the second cylinder are displaceable in a vertical direction from a height level of the remaining ones of the reversing cylinders in the normal group and the inverted group.

Web-drying air may be blown at a free, exposed side of the web over a turning sector of one or more of the reversing cylinders in the inverted group which is displaced upward from a height level of remaining ones of the reversing cylinders in the inverted group. Also, drying cylinders in the inverted group adjacent the upwardly displaced reversing cylinder may be displaced downward from the second height level.

In the following, the invention will be described in detail with reference to some exemplifying embodiments of the present invention illustrated in the figures in the accompanying drawing. However, the invention is by no means strictly confined to the details of these embodiments.

BRIEF DESCRIPTION OF THE DRAWINGS

The following drawings are illustrative of embodiments of the invention and are not meant to limit the scope of the invention as encompassed by the claims.

FIG. 2 shows a group gap transfer between an inverted dryer group and a normal group in which the web has a closed or substantially closed draw.

FIG. 4 shows an alternative group gap arrangement in accordance with the present invention in which the web has an open draw.

DETAILED DESCRIPTION OF THE INVENTION

Figure 1:
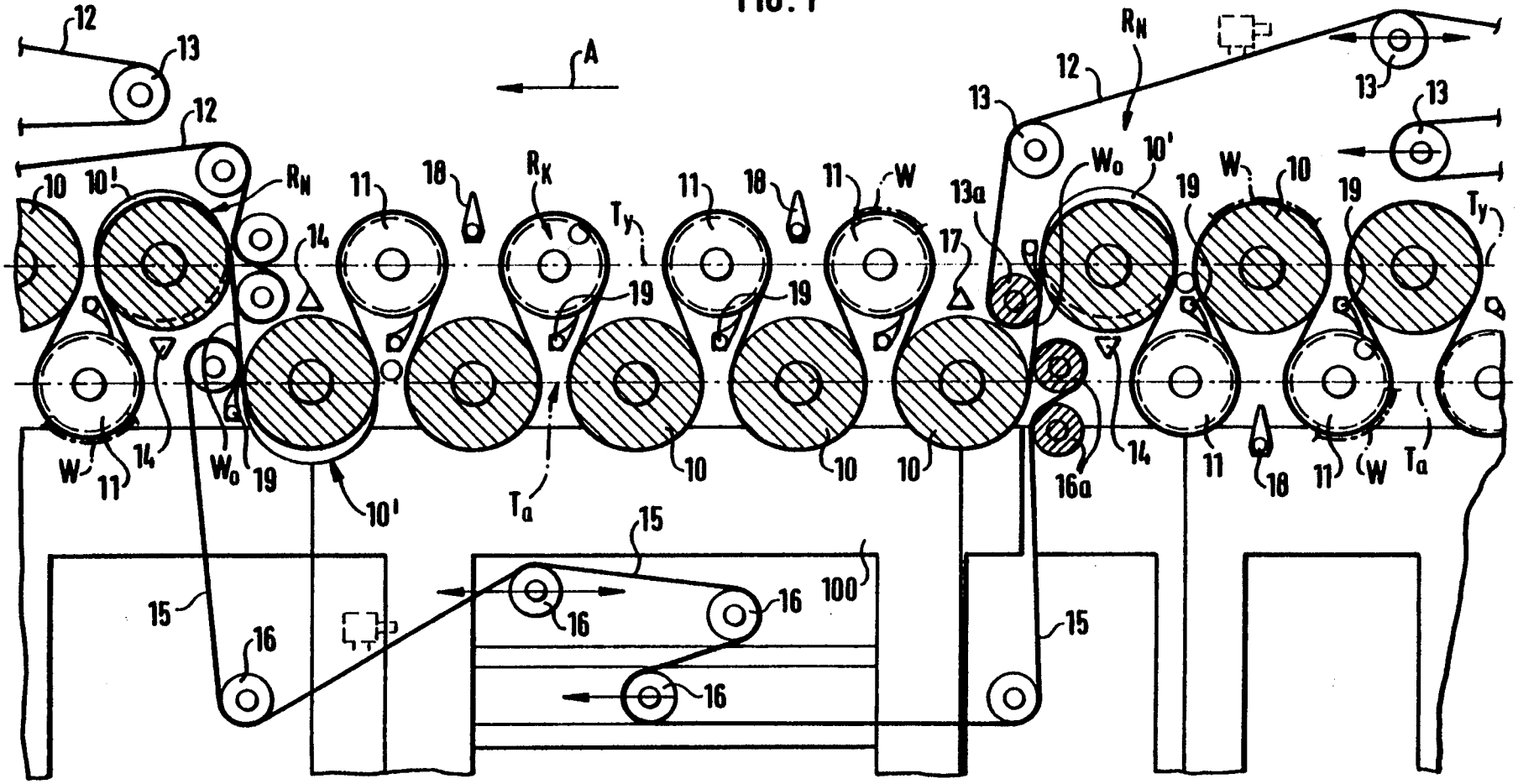
FIG. 1 shows group gap transfers in accordance with the present invention between two normal dryer groups and an inverted group placed between them and in which the web has an open draw.

In the Figures, the normal dryer groups similar to that defined above are denoted by reference $R_N$ and the inverted groups are denoted by reference $R_K$. The direction of progress of the web W to be dried in the dryer section, i.e., the running direction, is denoted by reference A.

Further, steam-heated drying cylinders are denoted by reference numeral 10 and reversing cylinders with reference numeral 11. In each of the normal groups $R_N$, there is an upper drying wire 12 which is guided by the guide rolls 13. In a corresponding manner, in each of the inverted groups, there is a lower drying wire 15 which is guided by the guide rolls 16. The prior art positions of the drying cylinders are illustrated by the shaded circles. In the Figures, a frame construction 100 of the dryer section is illustrated schematically.

In a typical dryer section in accordance with the present invention, the press section is first followed by four normal groups $R_N$ placed one after the other, thereafter one inverted group $R_K$ group, and finally another normal group $R_N$ arranged after the inverted group. In addition to the groups $R_N$, $R_K$ mentioned above, after the groups, there may be one inverted group $R_K$ and one or several normal groups $R_N$ depending on the paper grade to be produced. Since, at the initial end of the dryer section, the web W has a higher moisture content and, thus, lower strength, so that the risk of break of the web W is higher than in the rear end of the dryer section, in the initial portion of the dryer section, normal groups $R_N$ are generally utilized. In normal groups, the removal of broke is less problematic because the normal groups $R_N$ are, by nature, open in a downward direction.

FIGS. 1, 3, 5, 6, 8 and 9 illustrate group gap embodiments in accordance with the present invention arranged at the gaps between two normal groups $R_N$ and an inverted group placed between them. There are steam-heated drying cylinders 10, against which the web W to be dried is placed in direct contact. The web is pressed in the normal groups $R_N$ by the upper drying wire 12 and in the inverted groups $R_K$ by the lower drying wire 15. In accordance with the present invention, with the exception of cylinders 10' placed at the vicinity of the group gaps, the drying cylinders 10 are placed in substantially the same horizontal plane.

In the following description, for the sake of conciseness, the designation reversing cylinder 11 will be used, which, with some exceptions, refers to suction cylinders or suction rolls. The drying wire 12,15 is placed in direct contact against the reversing cylinder 11 whereas, in such cases, the web W is placed outside, at the side of the outside curve. Thus, the reversing cylinders 11 are placed inside the loops of the drying wires 12,15 and the drying cylinders 10 are placed outside the loops of the drying wires. Even though, in the following, the designation reversing cylinder 11 will be used, element 11 can also be substituted for by rolls of smaller diameters, such as reversing suction rolls. The reversing cylinders 11 are preferably reversing cylinders marketed by the assignee under the trademark VAC-roll (diameter $\approx$ 1500 mm). Vac-rolls have a mantle which is perforated and includes grooves on the outside face and whose interior communicates with a source of negative pressure. The web W is held on the turning sectors of the reversing cylinders 11 by means of the difference in pressure produced by the negative pressure.

In the following, different exemplifying embodiments of the present invention, illustrated in the figures, will be described in more detail.

In FIG. 1, the web W proceeds in the direction of arrow A from a first normal group $R_N$ to an inverted group $R_K$ and then to a second normal group $R_N$. The last cylinder 10' in the first normal group $R_N$ is placed at a level higher than the other cylinders 10 in this group whose center axes are placed at the level $T_y$. In a corresponding manner, the last cylinder 10' in the inverted group $R_K$ is placed at a level lower than the other cylinders 10 in the group $R_K$, i.e., its center axis is placed at a level lower than the normal level $T_a$. Correspondingly, the first cylinder 10' in the second normal group $R_N$ is placed in a position higher than normal.

It is the first purpose of the group gap arrangements shown in FIG. 1 that the evaporation of water from the web W should have more time before the web W ends up on the next wire 15;12, and the second purpose is to permit a packing of the group gaps in a more compact way in view of obtaining economies of space, i.e. reducing the overall length of the dryer section and/or in view of increasing its drying capacity, e.g., in connection with an increased running speed of the machine. In the first group gap $R_N$-$R_K$, the web W is separated from the drying wire 12 in the area of its guide roll **13*a*, being transferred as a free draw $W_0$ onto the drying wire 15 of the inverted group $R_K$ at its upper guide roll 16*a*. At its free draw $W_0$, water can evaporate from the web through both of its faces. FIG. 1 shows blow means 18 fitted in the gaps between the reversing cylinders 11, by which means the evaporation and/or the ventilation is/are intensified. Moreover, in connection with the free faces of the cylinders 11, air devices 19 are provided in the inlet nips between the web W and the drying wire 12,15, which air devices contribute to preventing the web W from being separated from the drying wire 12;15. The free sectors of the drying cylinders 10 are provided with cleaning doctors 14**.

FIG. 2 illustrates a group gap arrangement in a preferred embodiment of the present invention and the dimensions of same. The former group is an inverted group $R_K$, and the latter group is a normal group $R_N$. In the group $R_K$, the preceding drying cylinders 10 are arranged in the horizontal plane $T_a$, the last cylinder 10'' in the group $R_K$ is arranged at a height level lower than the plane $T_a$ by the dimension $H_a$. The reversing cylinders 11 in the group $R_K$ are placed in the plane $T_y$. The guide rolls **13*a* and 16*a* of the drying wires 12 and 15 are arranged so that the web W is given a closed or almost closed draw $W_1$. The first cylinder 10'' in the latter group $R_N$ is placed at a height level higher than the normal plane $T_y$ by the dimension $H_y$ whereby an advantageous group gap arrangement and a closed draw $W_1$ of the web W are obtained. The horizontal distance between the successive cylinders 10,10'' in the former group $R_K$ is denoted by reference $L_a$, the horizontal distance at the group gap, i.e., between the successive cylinders 10'', is denoted by reference $L_R$ and the horizontal distance between the cylinders 10 and 10''** in the latter group $R_N$ is denoted by reference $L_Y$.

In FIG. 2, Hy almost equals $H_a$ and is from about 100 mm to about 700 mm, preferably from about 150 mm to about 400 mm. A typical vertical distance H is usually about 1000 mm. Owing to the present invention, the length $L_R$ of the group gap can be reduced, compared with a normal group gap, by about 10% to about 20%, and the horizontal distances $L_Y$ and $L_a$ are reduced by about one half of that, i.e., by about 7% to about 10%. If the reduction in the horizontal dimension $L_R$ of a group gap given above is applied, e.g., in four group gaps, the dryer section can be shortened by about 2 m, which translates to substantial economies both in the cost of the dryer section and in the cost of the machine hall.

Figure 3:
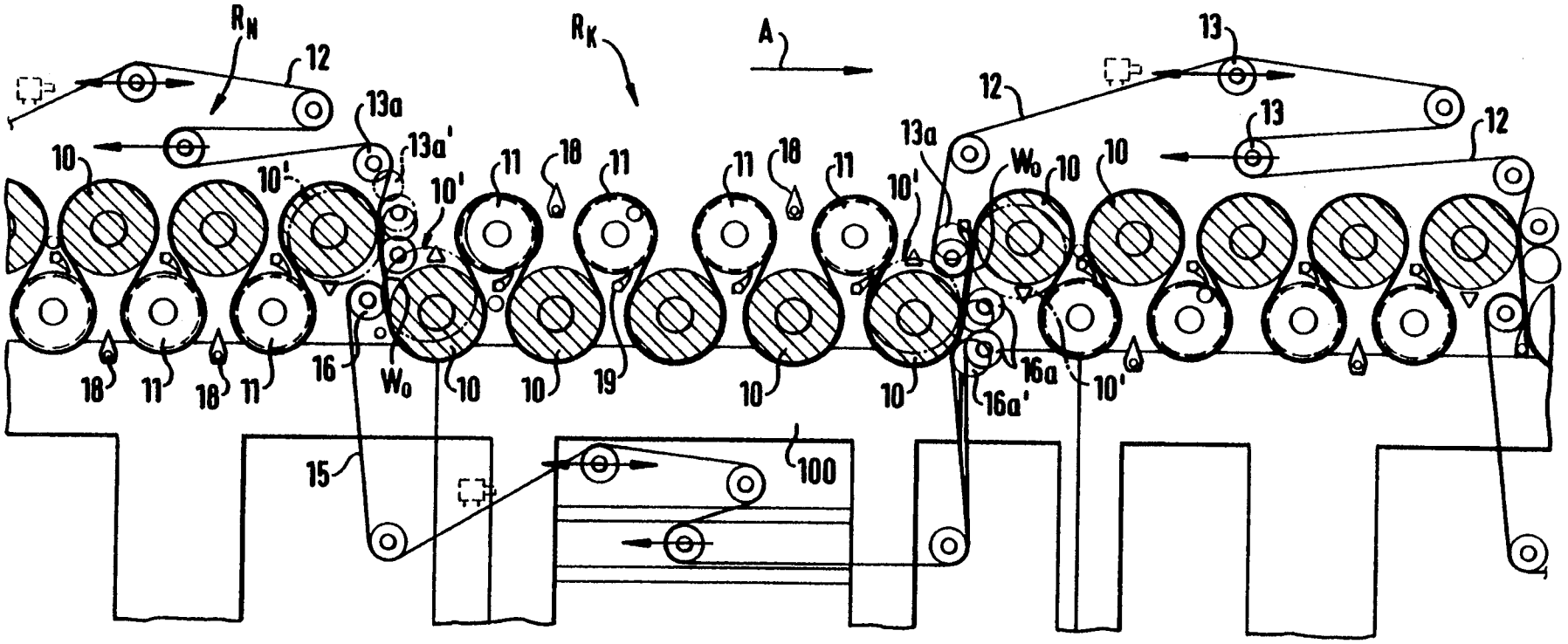
FIG. 3 shows, in a manner corresponding to FIG. 1, an embodiment of the present invention in which the last cylinder in the preceding dryer group and the first cylinder in the following group are placed at different levels and closer to one another, as compared with the other cylinders.

In a manner corresponding to FIG. 1, FIG. 3 shows group gap arrangements in which the last cylinder 10' in the former normal group $R_N$ is placed in a position lower than normal, and the last cylinder 10' in the group $R_K$ is arranged in a position higher than normal. The prior art positions of drying cylinders 10 are illustrated by shaded circles, as are the positions of the guide rolls **13*a* and 16*a*. The positions of the cylinders 10' that have been changed in accordance with the invention and the changed positions of the guide rolls 13*a'* and 16*a'* are illustrated by circles without shading. As illustrated above, the drying cylinders 10,10'** arranged in connection with the group gaps can be brought closer to one another, in which case the free gap of the web W from these cylinders onto the next cylinder also becomes shorter. Owing to this shortened gap, a more efficient prevention of the transverse shrinkage of the web and an improved runnability are obtained. The web has free draws $W_0$ at the group gap transfers.

FIG. 4 shows a group gap transfer arrangement in which the web may run in either direction (two-headed arrow), i.e., the arrangement in accordance with the present invention at the group gap may be between a normal group $R_N$ and an inverted group $R_K$ or vice versa. In the inverted group $R_K$, all the drying cylinders 10 and the reversing cylinders 11 are arranged in the same planes $T_a$ and $T_y$ with one another. In the normal group $R_N$, the first or the last cylinder 10' (depending on the running direction of the web W) is arranged at a height level higher than the normal plane $T_y$ by the dimension Hy and the first or last reversing roll 11' in the group $R_N$ is arranged at a height level higher than the normal plane $T_a$ by the dimension Ha. The web has a free draw $W_0$ at the gap between the groups $R_N$,$R_K$. In the group $R_N$, the normal height is such that the distance between cylinder 10 and reversing roll 11 (H) approximates the distance between cylinder 10' and reversing roll 11' ($H_0$). In a group gap as shown in FIG. 4, if normal positions were used for the cylinders 10 and 11, long draws with resulting risks in the runnability would result.

Figure 5:
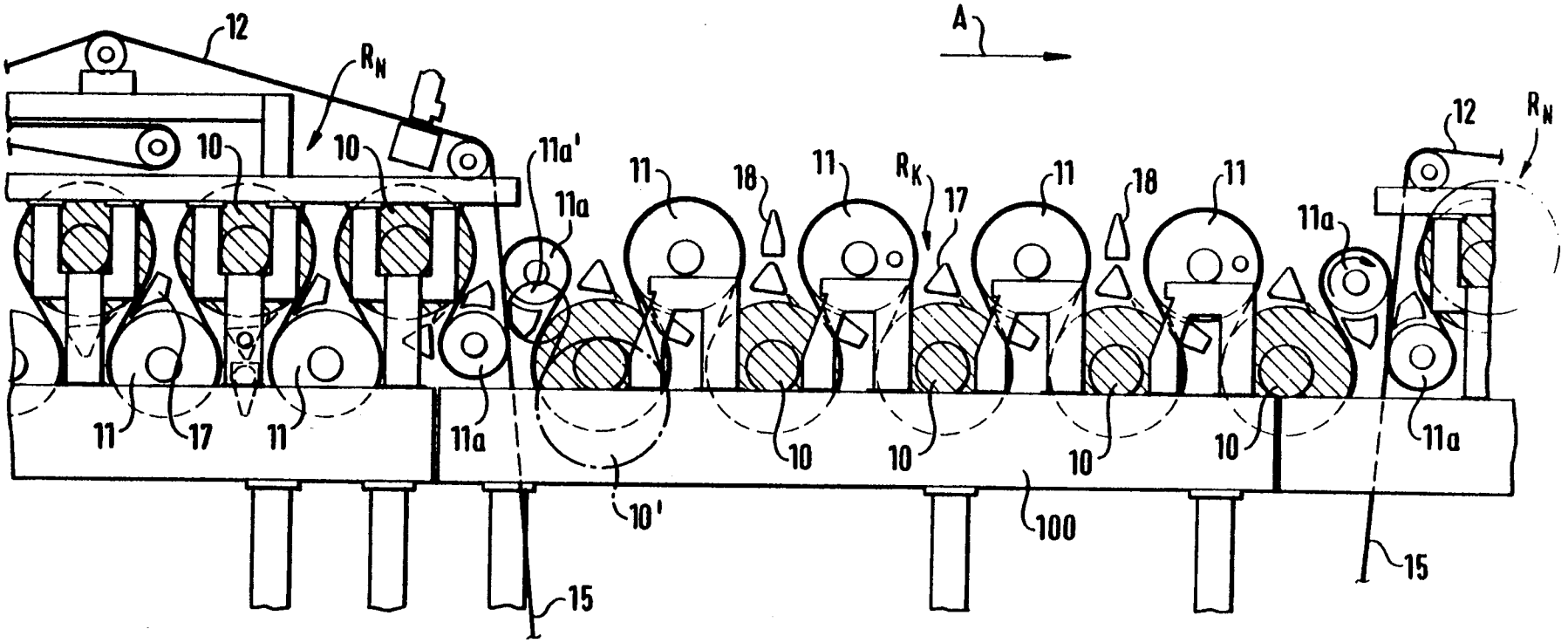
FIG. 5 shows, in a manner corresponding to FIGS. 1 and 3, group gap transfers between normal dryer groups and an inverted group placed between them, whereby the distance passed by the web at a group gap is reduced to achieve reduced cooling of the web at the group gap.
Figure 6:
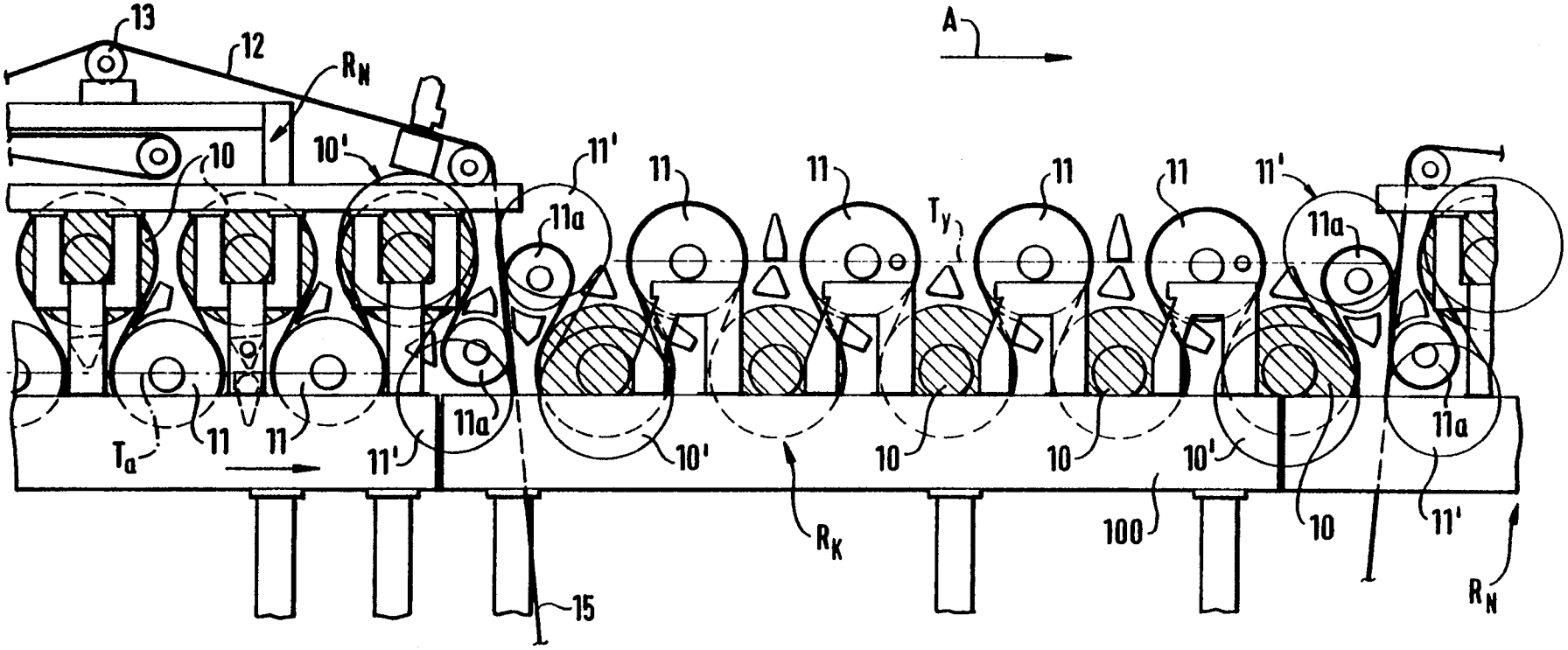
FIG. 6 shows, in a manner corresponding to FIGS. 1, 3 and 5, group gap transfers between normal dryer groups and an inverted group placed between them, whereby economies of space are obtained and the differences in speed are reduced.
Figure 9:
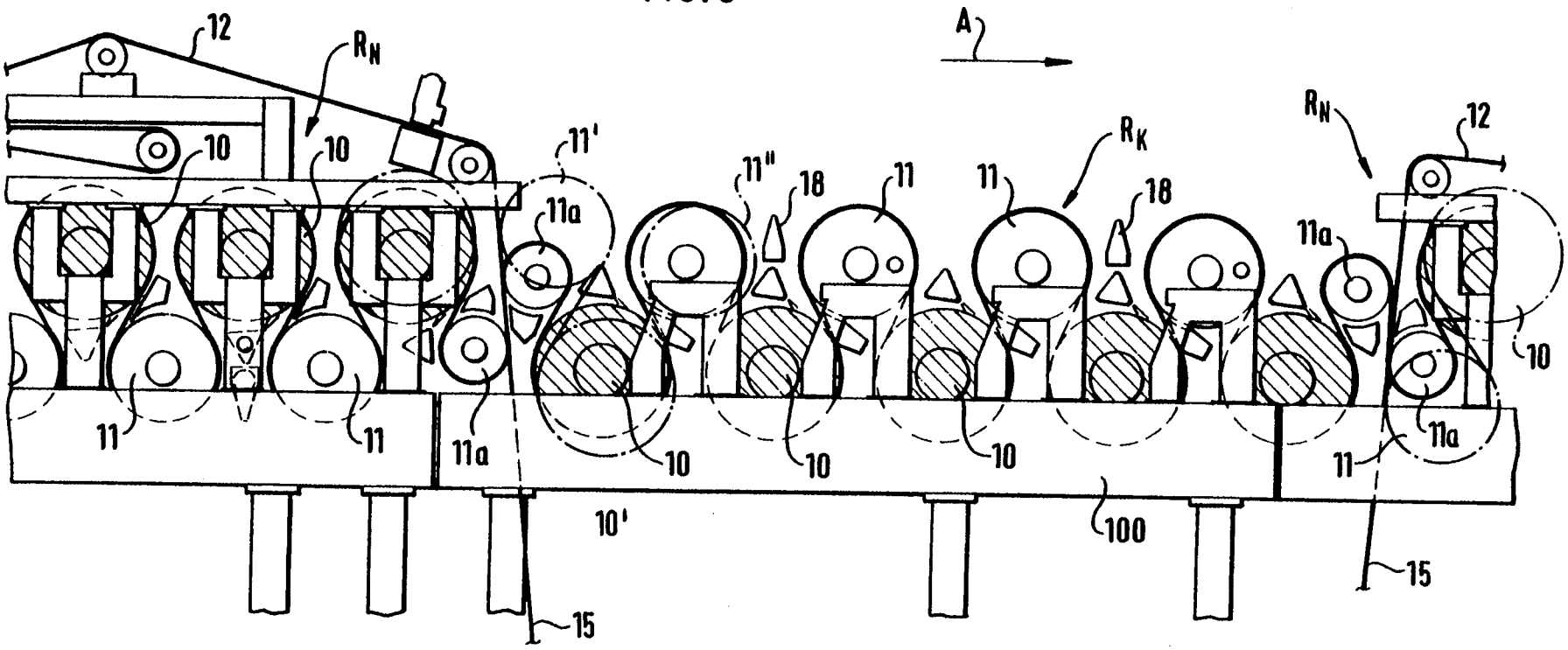
FIG. 9 shows, in a manner corresponding to FIGS. 1, 3, 5, 6 and 8, a group gap transfer between two normal dryer groups and an inverted group placed between them whereby the risk of difference in speed produced by the pair of suction rolls is reduced.

In FIGS. 1, 3 and 4, the web W is shown to have an open draw $W_0$ at the group gaps, whereas in FIGS. 5, 6 and 9, the web W has a closed or almost closed draw at the group gaps. In FIG. 5, in connection with the group gaps, a reversing roll 11*a* smaller than the normal reversing cylinders 11 is used. Moreover, at the gap between the groups $R_N$-$R_K$, a preferred alternative position 11*a*' is shown for the first reversing roll 11*a*, and a preferred alternative lower position 10' is shown for the first cylinder in the group $R_K$. The diameter of the reversing rolls 11*a*,11*a*' ($D_K$) is about 1000 mm. By means of the alternative positions 10' and 11*a*' of the parts 10 and 11, for example, reduced cooling of the web W at the group gap is achieved. For the removal of broke and cleaning, this arrangement is preferable in connection with easy entry into the inverted group $R_K$. The prior art group gap arrangements corresponding to FIG. 5 include the drawback that the web W is cooled for a relatively long time inefficiently because the heated face of the web is placed against the drying wire, in which case no significant evaporation takes place.

In FIG. 6, at the first group gap transfer $R_N$-$R_K$, reversing cylinders 11' of normal size (e.g., having a diameter $D_K$ of about 1500 mm) are used, whose diameter is substantially larger than that of the reversing rolls 11*a*. As such, it is possible to minimize differences in speed which deteriorate the quality of the web W, and to obtain economies of space. Moreover, the last cylinder 11' in the former group $R_N$ is placed at a height level lower than the normal plane $T_a$ and the first reversing cylinder 11' in the latter group $R_K$ is placed at a height level higher than the normal plane $T_y$. In a corresponding manner, the last cylinder 10' in the former group $R_N$ and the first cylinder 10' in the latter group $R_K$ are placed in a raised and lowered position, respectively.

Figure 7:
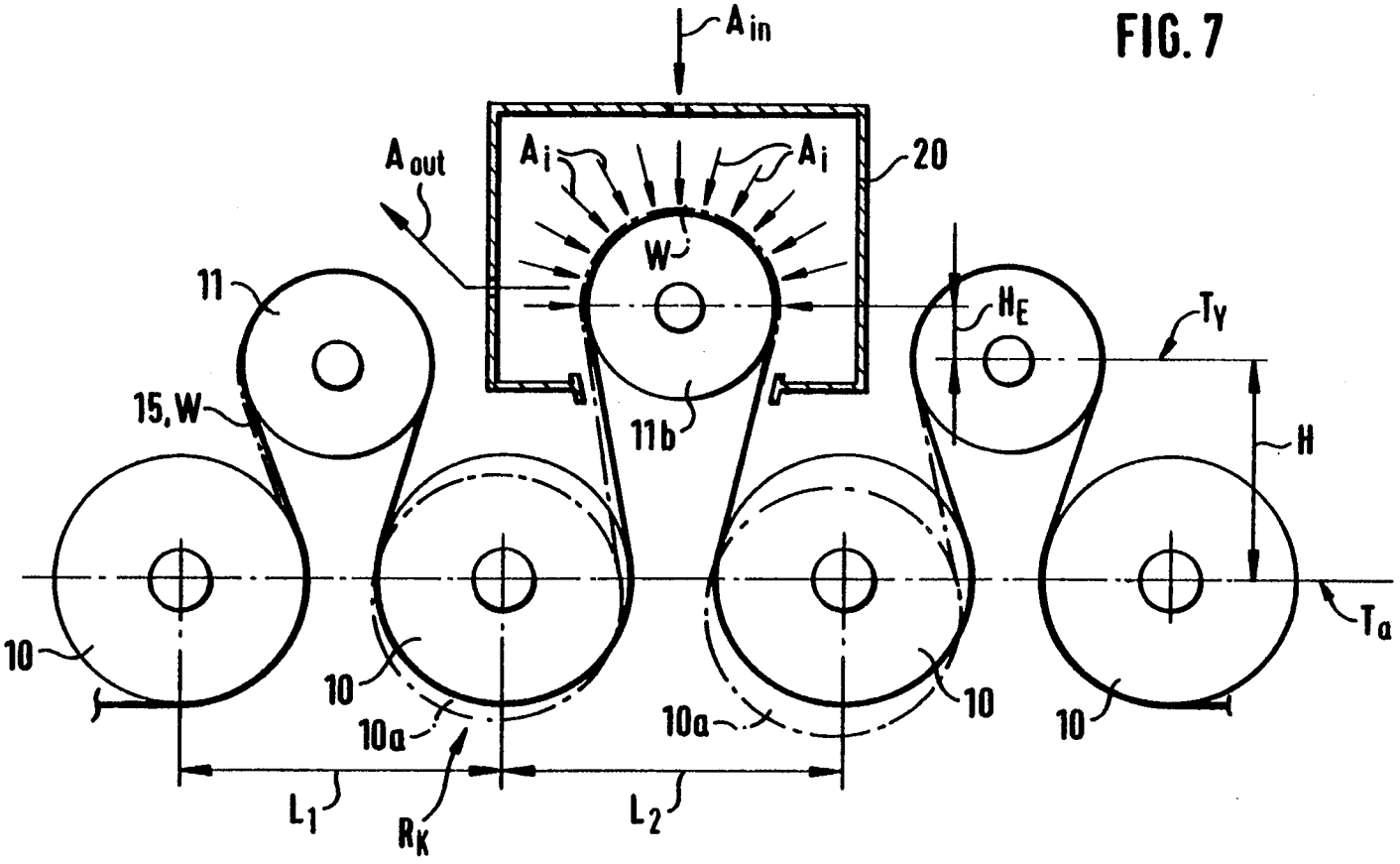
FIG. 7 shows an inverted group in accordance with the present invention in which a reversing suction roll is arranged at a level higher than normal and has a miniature hood.

In FIG. 7, an arrangement in accordance with the present invention is shown wherein an inverted cylinder group $R_K$ has an upper reversing cylinder 11*b* arranged at a height level higher than the normal plane $T_y$ by the dimension $H_E$. In such a case, it is possible to keep the horizontal dimensions unchanged, i.e., so that the distance between the drying cylinders 10 and 10*a* on either side of the raised cylinder 11*b* ($L_1$) approximates the distance between cylinders 10 ($L_2$). Owing to the raised position of cylinder 11*b*, space is provided for a miniature hood 20, or other comparable blow means, which is arranged on the reversing cylinder 11*b* to blow jets $A_i$ of drying air against the free face of the web W. A flow of drying air is introduced into the miniature hood 20 in the direction of the arrow $A_{in}$ and moistened air is removed from the hood 20 in the direction of arrow $A_{out}$, so that the blow segments (arrow $A_i$) and the exhaust segments are placed alternatingly in the transverse direction. The air blowings are applied over substantially the entire turning sector of the web on the reversing cylinder 11*b*.

In an inverted group or groups $R_K$, it is possible to arrange more than one miniature hoods 20. However, preferably the hoods are not arranged in connection with directly adjacent reversing cylinders 11. Owing to the air blows $A_i$ in the miniature hoods 20, it is possible to increase the evaporating capacity of the group and/or to use the hood 20 or hoods for the control of the transverse moisture profile of the web W by arranging the blow segments to be adjustable in the transverse direction.

Instead of, or in addition to, the raised position of the reversing cylinder 11*b*, it is possible to use an arrangement in which the drying cylinders 10 adjacent to the reversing cylinder 11*b* are placed in lower positions 10*a*, which are denoted by dashed lines. By means of the raised position of the reversing cylinder 11*b* (at a height $H_E$ above the height of the remaining reversing rolls 11) and/or by means of the lowered positions of the adjacent drying cylinders 10*a*, an advantage is obtained that the web is provided with more evaporation time, which contributes to an intensification of the drying. The increased evaporation time results from a lengthening of the run of the web between the reversing cylinder 11*b* and the adjacent lowered drying cylinders. Thus, the present invention can be used as a method for intensifying the drying of the web.

Figure 8:
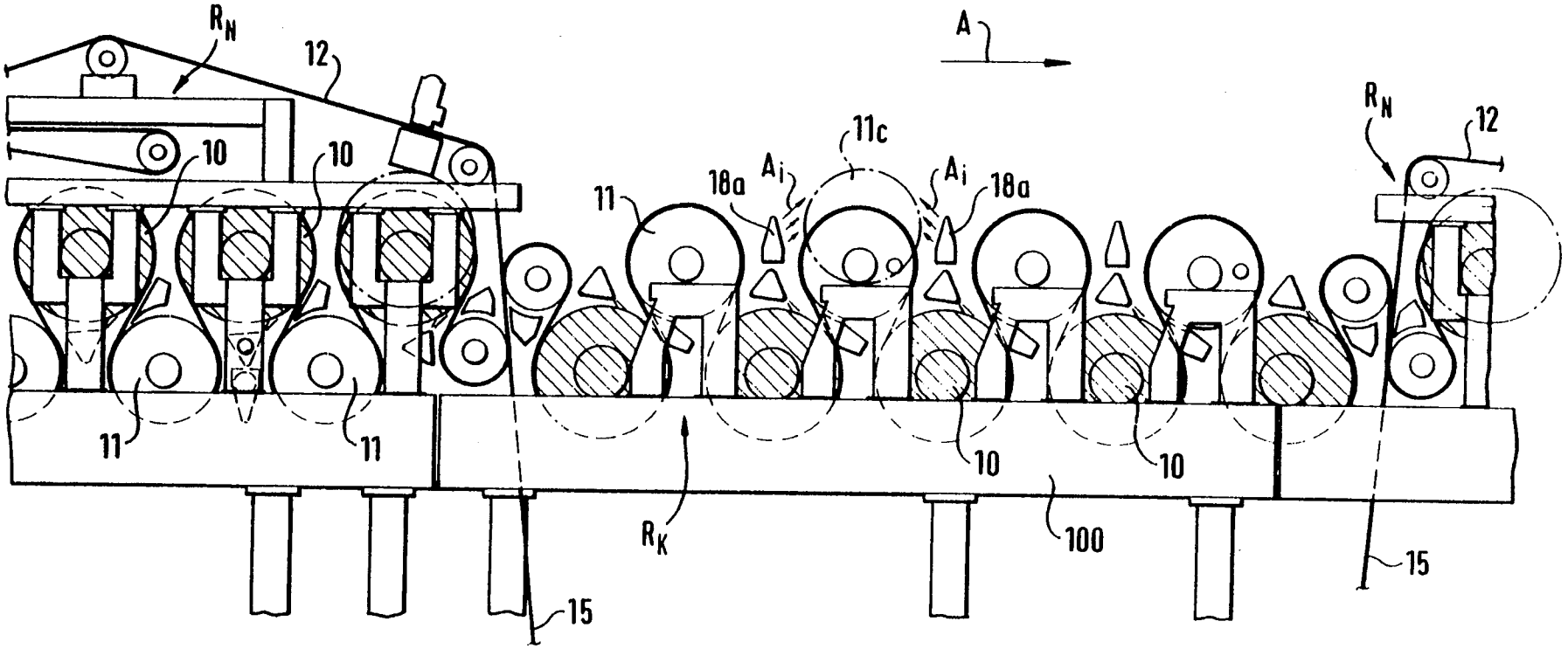
FIG. 8 shows a variation of the embodiment shown in FIG. 7 in an inverted group placed between two normal groups and in which a reversing cylinder is raised to a level higher than the other in order to provide space for ventilation and/or hot-air blowing means which intensify the evaporation.

FIG. 8 shows a modification of the embodiment illustrated in FIG. 7. In FIG. 8, a reversing cylinder 11*c* in the inverted group $R_K$ is arranged at a height level higher than the normal position, i.e., the height of the remaining reversing cylinders. Blow boxes 18*a* are arranged at both sides of the reversing cylinder 11*c*. Blowings $A_i$ are applied from the blow boxes 18*a* toward the face of the web W that runs free, i.e., the exposed side, so that the drying is intensified and/or the transverse moisture profile of the web W is controlled. It is also possible to arrange the drying cylinders 10 at both sides of the reversing cylinder 11*c* in lowered positions corresponding to the position 10*a* shown in FIG. 7. Owing to the raised position of the cylinder 11*c*, more space and an increased range of action is obtained for the ventilation and/or hot-air blow means 18*a* that intensify the evaporation. In this embodiment also, the drying cylinders adjacent to the raised reversing cylinder 11*c* may be lowered to a height level different than the height level of the remaining drying cylinders in the inverted group.

FIG. 9 shows a group gap transfer at which the web W is transferred from the reversing roll 11*a* in the former normal group $R_N$ onto the first reversing cylinder 11' in the inverted group Cylinder 11' is arranged in a position higher than its normal position, i.e., the position of the remaining reversing cylinders 11, whereas the next reversing cylinder 10' in the group $R_K$ is arranged at a height level lower than its normal position i.e., the position of the remaining reversing cylinders 10. The next reversing roll 11*a*'' is arranged in a horizontal position that has been shifted forward from its normal position in the direction of progress of the web W. In a corresponding arrangement, regarding the first lower reversing cylinder 11' in the latter group $R_N$, instead of the reversing rolls 11*a* of small diameter, it is possible to use reversing cylinders of larger diameter, whose diameter $D_{KS}$ is about 1500 mm.

The typical diameter $D_S$ of the drying cylinders used in the present invention is about 1800 mm, the typical diameter $D_{KS}$ of the reversing cylinders is about 1500 mm, and the diameter $D_{KT}$ of the reversing rolls 13,13*a*,16 and 16*a* is from about 600 mm to about 800 mm. The diameter of the reversing rolls depending on the width of the paper machine.

Even though, above, it has been described that the reversing cylinders 11 should be preferably the assignee's VAC suction rolls with no internal suction box, it should be emphasized in this connection that the scope of the invention also includes applications in which, in the positions of the VAC rolls 11, traditional suction rolls provided with interior suction chambers are used. The diameter of the conventional suction rolls may be smaller than the diameters of the VAC rolls illustrated in the figures.

It should be added further that, as the wire guide rolls 13*a*,13*b*,16*a*,16*b*,11*a* placed at the group gap transfers, it is possible to use either rolls provided with suction zones or rolls with no suction, depending on the requirements of runnability.

The examples provided above are not meant to be exclusive. Many other variations of the present invention would be obvious to those skilled in the art, and are contemplated to be within the scope of the appended claims.

We claim:

1. A dryer section for drying a paper web in a paper machine, comprising a normal dryer group having a single-wire draw, said normal dryer group having drying cylinders arranged in an upper row at a first height level and reversing cylinders arranged in a lower row, and an inverted dryer group having drying cylinders arranged in a lower row at a second height level and reversing cylinders arranged in an upper row, such that a web is transferred over a gap between said normal dryer group and said inverted group, at least one of said drying cylinders arranged in connection with the transfer of the web over said gap being displaced from said first height level or said second height level, such that evaporation of water from the web is intensified, transverse shrinkage of the web is reduced and runnability of the web is improved.

2. The dryer section of claim 1, wherein said at least one drying cylinder is arranged in said normal dryer group and displaced from said first height level.

3. The dryer section of claim 1, wherein said at least one drying cylinder is arranged in said inverted group and displaced from said second height level.

4. The dryer section of claim 1, comprising a first and second drying cylinder arranged in connection with the transfer of the web over said gap, said first drying cylinder being arranged in said normal dryer group and displaced from said first height level said second drying cylinder being arranged in said inverted group and displaced from said second height level.

5. The dryer section of claim 1, further comprising wire-leading rolls arranged between said normal dryer group and said inverted group, said at least one drying cylinder having a diameter substantially larger than the diameter of said wire-leading rolls.

6. The dryer section of claim 1, wherein the distance between one of said drying cylinder in said normal dryer group arranged in connection with the transfer of the web over said gap and one of said drying cylinder in said inverted group arranged in connection with the transfer of the web over said gap is shorter by about 10% to about 20% than a gap between successive cylinders in said normal dryer group or said inverted group.

7. The dryer section of claim 1, wherein the web is transferred in said gap as an open draw, a closed draw or a substantially closed draw.

8. The dryer section of claim 1, wherein said at least one drying cylinder is displaced in the vertical direction a distance from about 100 mm to about 700 mm.

9. The dryer section of claim 1, wherein said at least one drying cylinder is displaced in the vertical direction a distance from about 150 mm to about 400 mm.

10. The dryer section of claim 4, wherein said first drying cylinder and said second cylinder are displaced in a machine direction so as to reduce the distance between said first cylinder and said second cylinder and reduce a free gap of the web between said normal dryer group and said inverted group.

11. The dryer section of claim 1, comprising a first and second drying cylinder arranged in connection with the transfer of the web over said gap, a first reversing cylinder arranged adjacent said first cylinder and a second reversing cylinder arranged adjacent said second cylinder, at least one of said first reversing cylinder and said second reversing cylinder being displaced in a vertical direction from a height level of remaining ones of said reversing cylinders in said normal dryer group and said inverted group.

12. The dryer section of claim 1, wherein one of said drying cylinders and said reversing cylinders arranged in connection with the transfer of the web over said gap has a raised height position above the height position of remaining ones of corresponding drying cylinders or reversing cylinders.

13. The dryer section of claim 1, wherein said reversing cylinders have a substantially small diameter and are arranged in a height position to achieve a reduced cooling of the web at the gap between said normal dryer group and said inverted group.

14. The dryer section of claim 4, wherein said reversing cylinders have substantially equal diameters, said first cylinder being displaced upward in relation to said first height level and said second cylinder being displaced downward in relation to said second height level.

15. The dryer section of claim 14, wherein the gap between said normal dryer group and said inverted group is a closed draw, and at least one of a height position and a horizontal position of at least one of said first cylinder, said second cylinder, said first reversing cylinder and said second reversing cylinder is shifted in relation to remaining ones of corresponding cylinders and reversing rolls in said normal dryer group and said inverted group.

16. The dryer section of claim 1, wherein said reversing cylinders are suction-reversing cylinders having a grooved face and perforated mantle subjected to negative pressure.

17. The dryer section of claim 1, wherein said reversing cylinders are VAC suction-reversing cylinders lacking suction chambers, an interior of mantles of said suction-reversing cylinders communicating with a source of negative pressure.

18. The dryer section of claim 5, wherein said wire-leading rolls are selected from the group consisting of rolls provided with suction and rolls without suction.

19. The dryer section of claim 5, wherein the diameter of said reversing cylinders is about 1.5 m, and the diameter of said wire-leading rolls is from about 0.6 m to about 0.8 m.

20. The dryer section of claim 1, wherein said reversing cylinders in said inverted group are arranged at a third height level, further comprising blow means for blowing web-drying air, said blow means being arranged in proximity to a first one of said reversing cylinders in said inverted group, the web-drying air from said blow means increasing evaporation of water from the web and controlling a transverse moisture profile of the web, at least one of said first reversing cylinder and drying cylinders arranged adjacent to said first reversing cylinder being displaced.

21. A dryer section for drying a paper web in a paper machine, comprising an inverted dryer group having drying cylinders arranged at a first height level and reversing cylinders arranged at a second height level, and blow means for blowing web-drying air, said blow means being arranged in proximity to a first one of said reversing cylinders, the web-drying air from said blow means increasing evaporation of water from the web and controlling a transverse moisture profile of the web, at least one of said first reversing cylinders and drying cylinders arranged adjacent to said first reversing cylinder being displaced.

22. The dryer section of claim 21, wherein said first reversing cylinder is displaced upward from said second height level and said drying cylinders arranged adjacent to said first reversing cylinder are displaced downward from said first height level.

23. The dryer section of claim 21, wherein said blow means comprise a miniature hood arranged on said first reversing cylinder.

24. The dryer section of claim 21, wherein said blow means comprise blow boxes arranged on both sides of said first reversing cylinder, said blow boxes directing air blowings toward a free, exposed face of the web.

25. A method for intensifying evaporation of water from a web, reducing transverse shrinkage of the web and improving runnability of the web in a dryer section of a paper machine, comprising the steps of:

providing a normal dryer group having a single-wire draw, drying cylinders in an upper row at a first height level and reversing cylinders in a lower row, providing an inverted dryer group having drying cylinders in a lower row at a second height level and reversing cylinders in an upper row, transferring the web over a gap between said normal dryer group and said inverted group, and arranging at least one of said drying cylinders in connection with the transfer of the web over said gap in a displaced position from said first height level or said second height level.

26. The method of claim 25, further comprising arranging one of said reversing cylinders situated adjacent said first cylinder or said second cylinder at a distance from a height level of remaining ones of said reversing cylinders in said normal dryer group or said inverted group, respectively.

27. The method of claim 25, further comprising lengthening said gap by arranging one of said drying cylinders in said normal dryer group in a position displaced upward in relation to said first height level and arranging one of said drying cylinders in said inverted group in a position displaced upward in relation to said second height level.

28. The method of claim 25, further comprising blowing web-drying air at a free, exposed side of the web over at least one of said reversing cylinders in said inverted group, and arranging said at least one reversing cylinders in a position displaced upward from a height level of remaining ones of said reversing cylinders in said inverted group.

29. The method of claim 28, further comprising arranging drying cylinders in said inverted group adjacent to said at least one reversing cylinder in a position displaced downward from said second height level.

* * * * *